US006736830B2

(12) United States Patent
Roust

(10) Patent No.: US 6,736,830 B2
(45) Date of Patent: May 18, 2004

(54) BABY PACIFIER

(76) Inventor: Deborah M. Roust, 4194 Honeysuckle Ct., Vadnais Heights, MN (US) 55127

( * ) Notice: Subject to any disclaimer, the term of this patent is extended or adjusted under 35 U.S.C. 154(b) by 0 days.

(21) Appl. No.: 09/933,997

(22) Filed: Aug. 20, 2001

(65) Prior Publication Data

US 2002/0026218 A1 Feb. 28, 2002

Related U.S. Application Data

(60) Provisional application No. 60/226,942, filed on Aug. 22, 2000.

(51) Int. Cl.[7] ..... A61J 17/00
(52) U.S. Cl. ..... 606/234
(58) Field of Search ..... 606/234, 235, 606/236; 215/11.1, 11.2, 11.3, 11.4, 11.5

(56) References Cited

U.S. PATENT DOCUMENTS

| | | | | |
|---|---|---|---|---|
| 3,424,157 A | | 1/1969 | Paolo | |
| 4,447,164 A | | 5/1984 | Berndt | |
| 5,013,321 A | * | 5/1991 | MacVane | 215/11.5 |
| 5,080,110 A | * | 1/1992 | Weldon et al. | 606/234 |
| 5,108,686 A | | 4/1992 | Griffin | |
| 5,300,089 A | | 4/1994 | Sassin | |
| 6,117,176 A | | 9/2000 | Chen | 623/36 |
| 6,161,710 A | | 12/2000 | Dieringer et al. | 215/11.4 |

FOREIGN PATENT DOCUMENTS

DE 3232 506 A1 1/1984

* cited by examiner

*Primary Examiner*—Kevin T. Truong
(74) *Attorney, Agent, or Firm*—Oppenheimer Wolff & Donnelly

(57) ABSTRACT

An infant pacifier that simulates the natural shape, structure and consistency of the human breast. The device is constructed to cause the infant to replicate the same oral motor skills that the infant uses during breast-feeding. Specifically, the device is constructed with a bell-shaped portion that is sufficiently firm that it will not collapse in the infant's mouth, and with a nipple portion that will elongate and rest against the soft palate when a normal sucking action is made by the infant, thus avoiding the potential for nipple confusion by the infant.

14 Claims, 3 Drawing Sheets

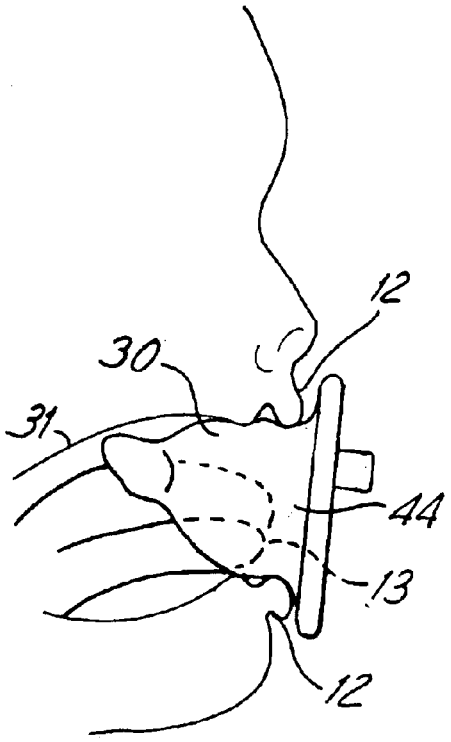
Fig. 3
Fig. 4
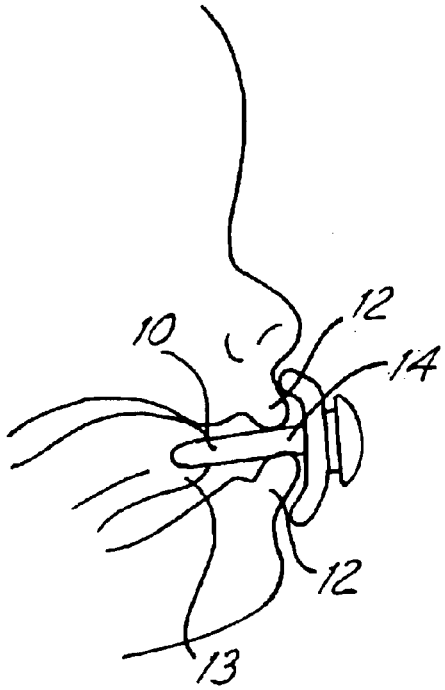

BABY PACIFIER

CROSS REFERENCE TO RELATED APPLICATION

This application claims the priority of U.S. Provisional Ser. No. 60/226,942, filed on Aug. 22, 2000.

BACKGROUND OF THE INVENTION

This invention relates to a pacifier for infants that will allow them to satisfy non-nutritional sucking needs without causing nipple confusion. More specifically, the pacifier of the present invention replicate the shape, structure, and consistency of the human female breast in order to create a device that stimulates the correct oral motor skills that are needed for breast-feeding.

The majority of women in the U.S. and other countries begin by breast-feeding their newborns. The benefits of breast-feeding are well established and fairly uniformly accepted by much of the general public as well as the American Academy of Pediatrics and World Health Organization.

The increase in breast-feeding awareness has lead to much research and recommendations to enhance the effectiveness and benefit of breast-feeding. Some of this research has been directed toward the subject of artificial nipples used with breast-feeding infants.

One problem that has been identified relates to nipple confusion. Generally, this problem is a result of two separate sucking actions learned by an infant due to the use of pacifiers or bottle nipples that differ from the female breast. In particular, infants become accustomed to the mouth, lip and tongue position required for breast-feeding that cannot be used when using today's common pacifiers. Unlike nursing, when using the common pacifier, the nipple collapses under the pressure from the infant's mouth and the infant cannot bring the nipple back in its mouth and onto the soft palate. Thus, the infant who is accustomed to the oral motor skills and mouth position used with breast-feeding, becomes confused and frustrated by the artificial nipple.

It has been well established by the American Academy of Pediatrics that supplements and pacifiers should be avoided, whenever possible, and if used at all, only after breast-feeding. The LaLeche League International has reported that babies sucking motion differs from bottle to breast. Hence, nipple confusion can take place if the baby receives artificial teats, such as bottles or pacifiers when trying to nourish from the breast using the same jaw and mouth motions that he uses with the artificial teat, or vice versa.

It is also known that infants need a varying amount of non-nutritive sucking to sooth and comfort themselves. Infants who are given artificial nipples for non-nutritive sucking needs will not be able to soothe and comfort themselves if the nipple cannot replicate the natural oral motor skills used in breast-feeding.

The infant mouth is not a miniature of an adult. A newborn has a set of sucking pads in the cheeks which provide stability during sucking. The palate forms the roof of the mouth; it consists of two portions, the hard palate (palatum durum) in the fort, the soft palate (palatum molle) behind. The soft palate is fibromuscular tissue located in the posterior one-third of the oral cavity. More specifically, the soft palate is a movable fold, suspended from the posterior border of the hard palate, and forms an incomplete septum between the mouth and pharynx.

Obviously, this is unnatural when compared with the positions and oral motor skills used when nursing. No pacifier has attempted to replicate the oral motor skills of infants by correct mouth positioning that is needed when breast-feeding. In breast-feeding, the infant's mouth is held open by taking in the nipple as well as a large area of the mother's areola. Further, the infant's lips are flanged out, the tongue rests over the bottom gums, and the nipple is drawn back to the soft palate. These positions and sucking actions are not used at all with standard pacifiers.

SUMMARY OF THE INVENTION

The invention is a pacifier for infants designed to replicate the anatomical structure, consistency and feel of the human female breast.

The pacifier of the present invention includes a flexible body structure which is fabricated from a pliable material. The flexible body structure is formed into a modified bell-shaped configuration with a main body portion and a nipple portion extending from an end thereof. This bell-shaped configuration is attached to a somewhat rigid base to allow easy handling and to help maintain the proper pacifier configuration. In this configuration, the pacifier is capable of acting like the female breast when placed in the mouth of an infant. This invention will be filled with a non-toxic material that will prevent the nipple from collapsing when the infant sucks and will provide a firm, widening surface at the outer portion. Using a two piece construction, the structure will prevent the infant from pursuing its lips around the end of the nipple where it inserts into the plastic mouth piece, and will encourage correct oral motor skills for breast-feeding infants. This invention will have an appropriate construction that allows the infant to pull the nipple onto the soft palate of its mouth. In one embodiment, this construction is a single wall of sanophrene with appropriate wall thickness to create the desired elastic characteristics. In an alternate embodiment, a double wall construction will be used to obtain these elastic characteristics.

It is an object of this present invention to simulate the natural shape of the human female breast, being structurally firm yet pliable in an infant pacifier, to replicate the necessary mouth positioning at the breast and oral motor skills used in breast-feeding.

Another object of this invention is to simulate the structure and consistency of the human female nipple versus the standard bellow nipple pacifier.

Another object of this invention is to provide a pacifier which is made of a resilient non-toxic material, durable in construction, inexpensive to fabricate, and simple to manufacture.

The embodiment discussed will comfort the infant, simulate the needed oral motor skills, decrease the chance of nipple confusion in breast-fed infants, and allow new parents to feel confident in providing their newborn with an artificial nipple when needed without interfering with breast-feeding.

BRIEF DESCRIPTION OF THE DRAWINGS

Further objects and advantages of the present invention can be seen by reading the following detailed description in conjunction with the drawings in which:

FIG. 3 is a schematic view of inventive pacifier in infant's mouth; and

FIG. 4 is a schematic view of a prior art pacifier as used by an infant.

DETAILED DESCRIPTION OF PREFERRED EMBODIMENTS

Figure 1:
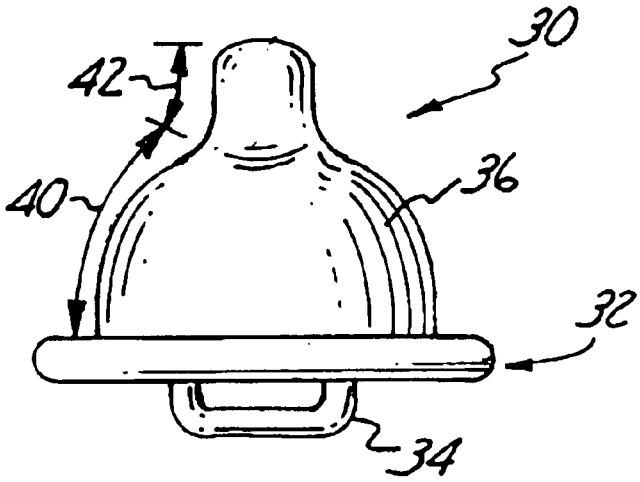
FIG. 1 is a side view of the pacifier of the present invention.

Referring now to the drawings in which like elements are signified using like numbers, the pacifier 30 of the present invention is shown in further detail. As can be seen in FIG. 1, pacifier 30 includes a rigid base 32 that includes a handle 34 attached thereto. In the preferred embodiment, both rigid base 32 and handle 34 are constructed of a molded plastic. These two elements may either be separate components or integral portions of a single molding. Attached to rigid base 32 is a flexible body portion 36. In order to operate appropriately, flexible body portion or structure 36 includes a bell shaped portion 40 and a nipple portion 42.

Figure 2:
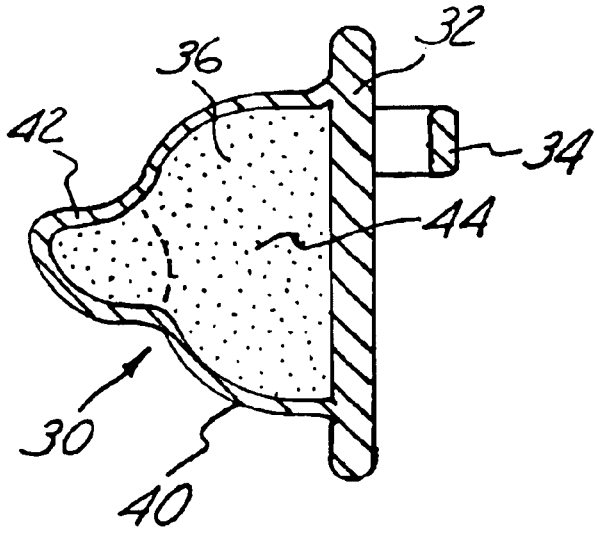
FIG. 2 is a cross-sectional view of the pacifier of the present invention.

Referring to FIG. 2, a cross-sectional diagram of pacifier 30 is shown to illustrate the internal construction thereof.

The anatomically fashioned pacifier 30 with small handle 34 is made of durable, non-toxic material. Flexible body structure 36 would be of relatively thin and elastic wall construction. This is the area that would be placed into the infant's mouth. Base plate 32 is made from a thicker less flexible material. A non-toxic filling material would fill internal space 44 and would simulate the consistency of the female breast.

As shown in FIG. 3 some elongating of pacifier 30 causes, the nipple being drawn back to the soft palate 31. The pacifier pliability allows a slight change in shape from FIG. 2 to now conform more to the infant's mouth. This figure shows the correct breast-feeding mouth position with both upper and lower lips 12 flanged out, and the tongue 13 positioned over the bottom gums. Again the filling of the pacifier allows the infant to maintain a more open mouth position by not collapsing. The wide base prevents the infant from pursing its lips.

Figure 5:
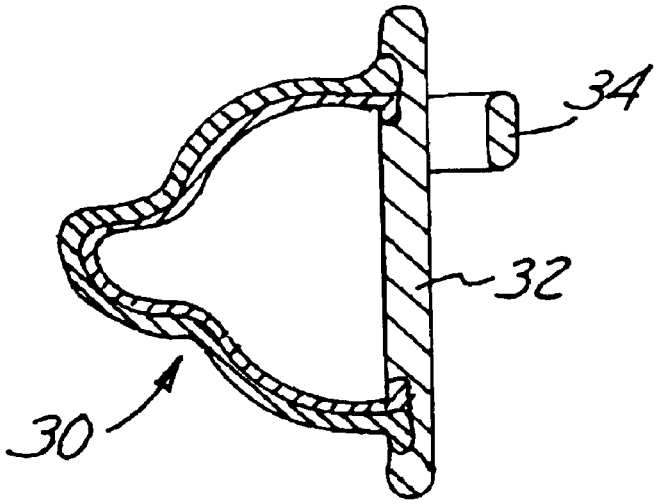
FIG. 5 is a cross-sectional view of the pacifier of the present invention having a multi-wall construction.

Referring again to FIG. 3, pacifier 30 is shown operating in accordance with the invention inside an infant's mouth. This can be compared with pacifier 30 as also shown from a side view 2 in FIG. 1, not in operation. Again pacifier 30 comprises a rigid base 32 having a handle 34 on the first side of the base and a support structure opposite the handle and a flexible body structure 36 attached to the rigid base 32, the body structure having a substantially bell shaped portion 42 and a substantially conical nipple structure 42. The body structure is configured to allow appropriate elongation and flexibility, which will then accommodate beneficial use by the infant. This structure may have a wall construction wherein the outer wall of bell-shaped portion 40 is thinner than the wall of nipple portion 42 and the two walls are configured sufficient to allow the outer wall at the nipple portion to elongate when the infant pulls the nipple into its mouth to reach the soft palate. The walls of the body structure should preferably be made of sanoprene or of some other flexible, non-toxic material with the characteristics of sanoprene that make it appropriate and economical for this use. Alternatively, a multi-layer or multi-walled construction may be used to achieve the desired elastic characteristics. This multi-walled construction is shown in FIG. 5.

The rigid base 32 should preferably have sufficient circumference so that when in use the infant's upper and lower lips will be flanged out, and the infant will be prevented from pursing its lips. More specifically, rigid base 32 will provide a structured attachment point for the bell-shaped portion 40. The cooperation of these elements will help to maintain the desired shape for flexible body structure 36, when in use.

The inner portion 44 of the flexible body structure 36 enclosed by the inner walls and the rigid base is filled with a non-toxic, viscous filling material such as glycerin.

The nipple portion 42 of the body structure 36 is of sufficient length to allow the infant to pull the nipple in to its mouth and onto its soft palate 31. A critical aspect of the present invention is that the nipple portion 42 is flexible enough so as to expand lengthwise and with minimal contraction widthwise when the pacifier is in use in an infant's mouth. Specifically, inner portion 44 maintains it volume when the nipple portion 42 is elongated in the infant's mouth. This facilitates pacification of the infant and better simulates oral motor skills and mouth position required for breast feeding.

Those skilled in the art will further appreciate that the present invention may be embodied in other specific forms without departing from the spirit or central attributes thereof. In that the foregoing description of the present invention discloses only exemplary embodiments thereof, it is to be understood that other variations are contemplated as being within the scope of the present invention. Accordingly, the present invention is not limited in the particular embodiments which have been described in detail therein. Rather, reference should be made to the appended claims as indicative of the scope and content of the present invention.

What is claimed is:

1. An anatomically correct pacifier for use by an infant so as to avoid nipple confusion, comprising:

a rigid base having a handle on a first side of the base and a support structure opposite the handle;

a flexible body structure attached to the rigid base, the body structure having a substantially bell shaped base portion extending outwardly from the rigid base and a substantially conically shaped nipple structure extending outwardly from a top portion of the bell shaped portion; and said body structure having a two layer wall construction throughout wherein the outer layer of the wall is thinner than the inner layer of the wall, and the space between the two wall layers is only enough to allow the nipple structure to elongate and conform to the infant's mouth;

wherein the flexible structure has sufficient length so as to allow the infant to pull the nipple into its mouth and onto the soft palate; and a viscous fluid filling the area between the inner wall and the rigid base of the body structure.

2. The pacifier of claim 1 wherein the body structure is constructed of sanoprene.

3. The pacifier of claim 1 wherein the viscous fluid is glycerin.

4. The pacifier of claim 1 wherein the viscous fluid simulates the consistency of the female breast.

5. The pacifier of claim 4 wherein the flexible nipple structure will expand in the lengthwise direction and contract in the widthwise direction when in use.

6. The pacifier of claim 1 wherein the rigid base is wide enough to prevent the infant from pursing its lips.

7. A pacifier for use in satisfying the non-nutritional sucking needs of an infant, comprising:

a rigid base portion;

a flexible body portion attached to the rigid base and having a first substantially bell shaped section, a second substantially conical section extending from an upper end of the first section, and a two wall construction, wherein the flexible body portion has sufficient length so as to allow the infant to pull the nipple into its mouth and onto the soft palate, and wherein the flexible body portion expands in the lengthwise direction and contracts in the widthwise direction when in use;

a viscous material filling a portion of the flexible body portion under the inner membrane; and a handle member rigidly attached to the rigid base, the handle member sealing with the flexibly body portion so as to enclose the area under the inner membrane and contain the viscous material.

8. An infant pacifier for providing correct oral motor skills as needed when breast-feeding, comprising:

a base member having a handle and an attachment surface;

a flexible body structure attached to the base member at the attachment surface, the body structure having base portion with a first predetermined diameter, and a nipple portion with a second predetermined diameter, wherein the first diameter is greater than the second diameter so as to prevent the infant from collapsing the base portion and achieving an unnatural mouth position that does not resemble a mouth position used during breast-feeding; and wherein the flexible body structure has sufficient length so as to allow the infant to pull the nipple into its mouth and onto the soft palate, and wherein the flexible body structure expands in the lengthwise direction and contracts in the widthwise direction when in use.

9. The infant pacifier of claim 8 wherein the flexible body structure and the base member create an enclosed area when attached, and wherein the enclosed area is filled with a viscous fluid to prevent collapsing of the body structure.

10. The pacifier of claim 9 wherein the viscous fluid is glycerin.

11. The pacifier of claim 10 wherein the viscous fluid simulates the consistency of the female breast.

12. The pacifier of claim 8 wherein the body structure is constructed of sanoprene.

13. The pacifier of claim 8 wherein the base member is wide enough to prevent the infant from pursing its lips.

14. An anatomically correct pacifier for use by an infant so as to avoid nipple confusion, comprising:

a rigid base having a handle on a first side of the base and a support structure opposite the handle; and a flexible body structure attached to the rigid base, the body structure having a substantially bell shaped base portion extending outwardly from the rigid base and a substantially conically shaped nipple structure extending outwardly from a top portion of the bell shaped portion; and said body structure having a wall construction configured to allow the nipple structure to elongate and conform to the infant's mouth and reach the soft palate; and wherein the flexible body structure has sufficient length so as to allow the infant to pull the nipple into its mouth and onto the soft palate, and wherein the flexible body structure expands in the lengthwise direction and contracts in the widthwise direction when in use.

* * * * *